United States Patent [19]

Liotta

[11] 4,372,750

[45] Feb. 8, 1983

[54] O-ALKYLATED/O-ACYLATED COAL AND COAL BOTTOMS

[75] Inventor: Ronald Liotta, Clark, N.J.

[73] Assignee: Exxon Research and Engineering Co., Florham Park, N.J.

[21] Appl. No.: 213,749

[22] Filed: Dec. 8, 1980

Related U.S. Application Data

[63] Continuation-in-part of Ser. No. 62,809, Aug. 1, 1979, Pat. No. 4,259,084, which is a continuation-in-part of Ser. No. 969,494, Dec. 14, 1978, abandoned, and Ser. No. 69,061, Aug. 23, 1979, Pat. No. 4,259,172, which is a continuation-in-part of Ser. No. 969,362, Dec. 14, 1978, abandoned.

[51] Int. Cl.[3] ..... C10L 5/00; C10L 9/02

[52] U.S. Cl. ..... 44/1 R; 208/8 LE

[58] Field of Search ..... 44/1 R; 208/8 LE, 10; 260/465.1, 465.3, 465.6

[56] References Cited

U.S. PATENT DOCUMENTS

| | | | |
|---|---|---|---|
| 3,359,197 | 12/1967 | Masciantonio et al. | 208/14 |
| 3,376,212 | 4/1968 | Masciantonio et al. | 208/2 |
| 3,992,432 | 11/1976 | Napier et al. | 260/465.1 |
| 4,059,410 | 11/1977 | Schlosberg et al. | 44/1 R |
| 4,072,475 | 2/1978 | Schlosberg et al. | 44/1 R |
| 4,263,123 | 4/1981 | Ebert et al. | 44/1 R |

FOREIGN PATENT DOCUMENTS 851191 5/1977 Belgium .

OTHER PUBLICATIONS

Chem. Structure and Properties of Coal, Blom et al., vol. 36, Fuel, pp. 135–153, 1957.

Methylation of Coals, Yohe et al., vol. 69, JACS, pp. 2644–2648, (1947).

Solubilization of Coals by Reductive Alkylation, Sternberg et al., vol. 53, Fuel, pp. 172–175, (1974).

Increase In Extractability of Bit. Coals caused by Friedel-Crafts Acylation, Hodek et al., vol. 52, Fuel, pp. 220–225, (1973).

*Primary Examiner*—Carl F. Dees

*Attorney, Agent, or Firm*—Henry E. Naylor

[57] ABSTRACT

Coal and coal bottoms characterized by having the hydrogens of substantially all of the hydroxyl and carboxyl groups, of the coal and coal bottoms replaced with $C_1$ to $C_{20}$ alkyl or acyl groups.

8 Claims, No Drawings

O-ALKYLATED/O-ACYLATED COAL AND COAL BOTTOMS

CROSS-REFERENCE TO RELATED APPLICATIONS

This is a continuation-in-part of two applications, one being U.S. Ser. No. 62,809, filed Aug. 1, 1979 U.S. Pat. No. 4,259,084 which is a continuation-in-part of U.S. Ser. No. 969,494, filed Dec. 14, 1978 and now abandoned, and the other being U.S. Ser. No. 69,061, filed Aug. 23, 1979 U.S. Pat. No. 4,259,172 which is a continuation-in-part of U.S. Ser. No. 969,362, filed Dec. 14, 1978 now abandoned.

BACKGROUND OF THE INVENTION

The present invention relates to oxygen-alkylated and/or oxygen-acylated coal and coal bottoms.

Coal, once the leading source of energy in the United States, is beginning to play a more important role in the nation's energy future. The primary reason for the growing importance of coal is the rapid depletion of known petroleum and natural gas reserves. These known reserves are being depleted at a rate considerably faster than the rate of discovering new reserves. As the era of petroleum growth draws to a close, the world's energy mix will have to change. Transition energy sources will be needed as a bridge between petroleum and the potentially unlimited energy sources of the furture; such sources being, for example, solar power and nuclear fusion. Owing to its great abundance, coal is perceived as one of the keystones of such a bridge. Consequently, much work is presently in progress to provide economical ways of converting coal to valuable liquids and gases as well as to ways of chemically modifying the structure of coal in order to produce a coal having greater utility than coal not so modified.

Processes for the liquefaction of coal and similar carbonaceous solids usually involve contacting the feed material with a hydrocarbon solvent and molecular hydrogen at elevated temperature and pressure. This results in partial breakdown of the complex high molecular weight starting material into lower molecular weight hydrocarbon liquids and gases. These are recovered from the liquefaction effluent, leaving a heavy liquefaction bottoms product which normally boils in excess of about 550° C. and generally contains suspended solid residues. The liquefaction bottoms may constitute 50% or more by weight of the total liquefaction products.

A variety of processes for upgrading liquefaction bottoms have been proposed in the past. Exemplary of these include pyrolysis of the bottoms that produce gases, additional hydrocarbon liquids and coke, followed by steam gasification of the coke to form hydrogen and carbon monoxide for use as a fuel; see e.g., U.S. Pat. No. 4,060,478. Another process for upgrading liquefaction bottoms is disclosed in U.S. Pat. No. 4,089,772 which discloses an acid-catalyzed C-alkylation of C-acylation of liquefaction product bottom prior to recycling the bottoms fraction to the liquefaction reaction zone.

These various processes result in more efficacious use of liquefaction bottoms. However, during subsequent coal liquefaction process, phenols present in the coal are cleaved to produce water. In liquefaction processes employing hydrogen, an excessive use of hydrogen thus occurs.

Solvent extraction of coal also leaves behind a high molecular weight, insoluble fraction of coal called coal solubilization bottoms. Like liquefaction bottoms, this heavy fraction is also the object of various upgrading processes in order to obtain increased liquid yields.

SUMMARY OF THE INVENTION

In accordance with the present invention, properties of coal and coal bottoms are improved by oxygen-alkylation and/or oxygen-acylation, which method comprises treating the solid carbonaceous material with (a) at least one quaternary base represented by the formula $R_4QOR''$ where each R is the same or different group selected from the group consisting of $C_1$ to about $C_{20}$ alkyl and $C_1$ to about $C_{20}$ aryl; Q is nitrogen or phosphorus; and R'' is selected from the group consisting of hydrogen, $C_1$ to about $C_{10}$ alkyl, aryl, alkylaryl, arylalkyl and acetyl; and (b) at least one compound represented by the formula R'X where R' is a $C_1$ to $C_{20}$ alkyl or acyl group and X is a leaving group selected from the group consisting of halide, sulfate, bisulfate, acetate and stearate, wherein X is attached to a primary or secondary carbon atom.

DETAILED DESCRIPTION OF THE INVENTION

The procedure that follows is especially useful for the selective alkylation or acylation of bituminous, subbituminous and lignite coals, peats, and coal bottoms.

Heavy coal fractions, also referred to herein as coal bottoms, are those residues derived from coal by a variety of processes including hydrogenation and donor solvent reactions involving a distillation to remove coal liquids. Coal liquefaction bottoms, though only a by-product of the liquefaction process, constitute an undesirably large fraction of the total liquefaction products. Exemplary of the solvent hydrogen donor liquefaction process is that described in U.S. Pat. No. 3,617,513.

Coal solubilization bottoms are those residues derived from coal by a variety of solvent extraction processes. Exemplary of the solvent extraction process is that described in U.S. Pat. No. 3,607,716, which discloses supercritical gas extraction.

The alkylation or acylation process disclosed herein may be advantageously employed with any heavy coal fractions, regardless of derivation. As used herein, the terms "coal bottoms" and "heavy fractions" are synonymous and relate to coal residues derived by coal treatment processes such as liquefaction, solubilization and the like. Certain gasification processes yield a by-product tar, which is also a coal residue contemplated for treatment by the process of the invention.

By the process of the invention, functionalities containing weakly acidic protons in the treated material are chemically altered. For example, acidic proton-containing groups such as phenolic and carboxylic, which are very polar functional groups are converted to relatively non-polar ethers and esters, respectively. The chemical transformation may be represented as follows:

$$Ar—OH + R'X \rightarrow Ar—OR'$$

$$Ar—COOH + R'X \rightarrow Ar—COOR'$$

where R' is a $C_1$ to about $C_{20}$ alkyl or acyl group.

The O-alkylation or O-acylation of coal and coal bottoms, by reagents which are in liquid solution, is greatly influenced by the use of a phase transfer reagent. Such a reagent has both a lipophilic and a hydrophilic portion and is capable of transferring a basic species, —OR", from an aqueous phase to either a solid or liquid organic phase, where R" is either hydrogen or a carbon-bearing functionality. The phase transfer reagent may be generated catalytically, in which case the process is termed a phase transfer catalysis, which is a well-known reaction; see, e.g., Vol. 99, *Journal of the American Chemical Society,* pp. 3903–3909 (1977). Alternatively, the reagent may be generated in a separate step, then used in the alkylation or acylation reaction. If this latter reaction is employed, then the active form of the reagent may be regenerated in a subsequent step. In either case, the overall chemical transformation on the coal bottoms is the same. A generalized mechanistic scheme for this transformation is shown below:

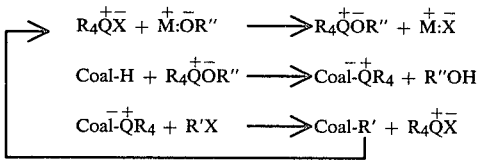

The phase transfer reagent is preferably a quaternary base represented by the formula $R_4QOR''$ where each R is the same or different group selected from the group consisting of $C_1$ to about $C_{20}$, preferably $C_1$ to $C_6$ alkyl and $C_6$ to about $C_{20}$, preferably $C_6$ to $C_{12}$ aryl group; Q is nitrogen or phosphorus, preferably nitrogen; and R" is selected from the group consisting of hydrogen, $C_1$ to about $C_{10}$, preferably $C_1$ to $C_6$ alkyl, aryl, alkylaryl, arylalkyl and acetyl group; more preferably a $C_1$ to $C_4$ alkyl group and most preferably nitrogen. The phase transfer reagent may be regenerated by reacting the corresponding quaternary salt $R_4QX$ with a metal base MOR" where X is selected from the group consisting of halide, sulfate, bisulfate, acetate and stearate. Preferred is when X is a halide and selected from the group consisting of chlorine, bromine and iodine, more preferably chlorine. M is selected from the group consisting of alkali metals, more preferably sodium and potassium. As shown above, the quaternary base is then reacted with the acidic groups on the coal which in turn is reacted with at least one alkylating or acylating agent represented by the formula R'X wherein R' is selected from the group consisting of $C_1$ to about $C_{20}$ alkyl or acyl group and X is as previously defined, as long as X is attached to a primary or secondary carbon atom. Preferably R' is an inert hydrocarbon—that is, a hydrocarbon group containing only hydrogen and carbon, although hydrocarbon groups containing other functionality may also be suitable for use herein, even though less desirable. It will be noted that the acidic proton H (hydrogen atom) is usually located on phenolic groups in higher rank coals and on carboxylic groups for lower rank coals. The acidic proton may also be located to a lesser extent on sulfur, nitrogen, etc.

Phase transfer reagents such as quaternary ammonium base ($R_4QOR''$) are very effective in the O-alkylation and O-acylation of coal bottoms. These O-alkylation and O-acylation reactions are successful because the —OR" portion of the molecule is soluble in an organic medium. When this base is present in such a medium, it is not solvated by water or other very polar molecules. As an unsolvated entity, it can react as a very efficient proton transfer reagent. For example $$(\text{Coal})\text{—OH} + O^-R'' \rightarrow (\text{Coal})\text{—}O^- + R''OH$$

This unsolvated base (also known as a "naked hydroxide" when R" is hydrogen) can have a wide variety of counter ions. Although the counterion may be a quaternary ammonium or phosphonium species as previously discussed, other examples of counter ions useful in the practice of the invention include "crown ether" complexes of a salt containing the OR" anion and clathrate compounds complexed with a salt containing the OR" anion. Salts represented by MOR", where M is as given above, when complexed with crown ethers, for example, have been previously demonstrated to evidence a reactivity similar to that found for $R_4QOR''$ compounds.

In one embodiment of the process of the invention, a two-phase solid/liquid system comprising the coal or coal bottoms in liquid suspension is formed. The coal or coal bottoms may be ground to a finely divided state and contain particles less than about ¼ inch in size, preferably less than about 8 mesh NBS sieve size, more preferably less than about 80 mesh. The smaller particles, of course, have greater surface area and thus alkylation or acylation will proceed at a faster rate. Consequently, it is desirable to expose as much coal surface area as possible without losing coal bottoms as dust or fines or as the economics of coal grinding may dictate. Thus, particle sizes greater than about 325 mesh are preferred.

Although not necessary, a solvent may be added if desired. The solvent may be used to dissolve alkylated or acylated carbonaceous product or to dissolve alkylating or acylating agent (especially if the agent is a solid and is comparatively insoluble in water). The solvent may also be used to provide for more efficient mixing. Many of the common organic solvents may be employed in any reasonable amount, depending on the desired result.

Inasmuch as there are solid carbonaceous particles which never dissolve in the course of the reaction, there may be some concern as to the extent of the reaction on these particles. To verify the complete extent of the reaction, these particles were collected and worked up separately on numerous runs with a wide variety of alkylating agents as well as coals. Infrared spectral analysis of this insoluble portion of the coal reaction mixture showed that in every case, substantially complete alkylation of the hydroxyl group had occurred. This is evidence that the phase transfer reagent must have penetrated the solid coal structure and that the resulting organic salt of the coal must have reacted with the alkylating agent to produce the observed product. Thus, the etherification and esterification reactions are not merely taking place on the surface of the carbonaceous material, but throughout the structure as well.

The phase transfer reagent that is used must dissolve in or be suspended in both phases so that it has intimate contact with both the organic and aqueous phases. During the course of the reaction, the phase transfer reagent will partition itself into both of these phases. Quaternary bases are one class of compounds useful as phase transfer reagents in the practice of the invention and are given by the formula $R_4QOR''$, where R is an alkyl or aryl group having at least one carbon atom, and preferably 1 to 20 carbon atoms, and more preferably 1 to 6 carbon atoms or an aryl group having 6 to 12 carbon atoms. The lower number of carbon atoms is preferred, since such compounds are more water soluble and can be removed from the alkylated or acylated coal bottoms by simple water washing. The R groups may be the same or different. Examples of R groups include methyl, butyl, phenyl and hexadecyl.

Examples of quaternary bases useful in the practice of the invention include the following:

1. Tetrabutylammonium hydroxide, $(C_4H_9)_4NOH$
2. Benzylhexadecyldimethylammonium hydroxide, $(C_6H_5CH_2)$ $(C_{16}H_{33})$ $(CH_3)_2NOH$
3. Tetrabutylphosphonium hydroxide $(C_4H_9)_4POH$
4. ADOGEN 464, $(C_8-C_{10})_4NOH$ (ADOGEN 464 is a trademark of Aldrich Chemical Co., Metuchen, N.J.).

The metal base used to convert the quaternary salt to the corresponding base is an alkali metal or alkaline earth metal base such as NaOH, KOH, $Ca(OH)_2$ or $NaOCH_3$. The use of an alkoxide, for example, permits use of the corresponding alcohol in place of water, which may provide an advantage of treating coal bottoms under conditions where water is not desired.

In choosing the alkylating and acylating reagent, two considerations must be weighed. First, it is desired to add longer chains to the coal and/or coal bottoms which render the product more petroleum-like, and therefore, more soluble in organic solvents and more compatible with petroleum liquids. On the other hand, shorter chains render the alkylated or acylated coal material more volatile. Second, shorter chain materials are also less expensive and still improve solubility.

In the case of O-alkylation, the carbon to which the leaving group is attached may be either a primary or secondary carbon atom. Primary carbon halides have been found to react faster than the corresponding secondary halides in a phase transfer or phase transfer catalyzed reaction on carbonaceous materials and are accordingly preferred. While the balance of the carbon-bearing functional group may, in general, contain other moieties, such as heteroatoms, aryl groups and the like, bonding of the carbon-bearing functional group to the phenolic or carboxylic oxygen is through either an $sp^3$ hybridized carbon atom (alkylation) or an $sp^2$ hybridized carbon atom (acylation). Further, a mixture of alkylating or acylating agents or a mixture of both may advantageously be employed. Such mixtures are likely to be generated in coal-treating plants in other processing steps and thus provide a ready source of alkylating and/or acylating agents. Examples of alkylating and acylating agents useful in the practice of the invention include ethyl iodide, isopropyl chloride, dimethyl sulfate, benzyl bromide and acetyl chloride.

While alkylating and/or acylating agents are employed in the practice of the invention, alkylating agents are preferred for the following reasons. First, alkylating agents are readily prepared from their hydrocarbon precursors. For example, alkyl halides may be easily prepared by free radical halogenation of alkanes, which is a well known process. When a system containing more than one alkylating or acylating agent is used, the hydrocarbon precursor is preferably a product stream of a certain cut derived from coal and petroleum processing and the like. This stream may contain minor amounts of components having various degrees of unsaturation which are also suitable for reacting with the phenolic and carboxylic groups herein, as long as X (as previously defined) is attached to an alkyl or saturated carbon atom in the resulting alkylating or acylating reagent. Second, acylating reagents are susceptible to hydrolysis. Since water is present due to the nature of the inventive process, some loss of acylating agent may occur by hydrolysis. In contrast, alkylating reagents do not evidence the same susceptibility to hydrolysis.

If the O-alkylation or O-acylation is carried out by a catalytic process, then the quaternary salt, metal base and alkylating or acylating agent are mixed directly with an aqueous slurry of coal bottoms. The quaternary salt catalyst may be present in small amounts, typically about 0.05 to 10 wt. % of the amount of coal or coal bottoms used; however, greater amounts may also be employed. The metal base and the alkylating or acylating agent must be present in at least stoichiometric quantities relative to the number of acidic sites (phenolic, carboxylic, etc.) on the coal or coal bottoms, but preferably an excess of each is used to drive the reaction to completion. Advantageously, a two-fold excess of metal base and alkylating or acylating agent is employed; however, a greater excess may be employed. After the reaction, the excess quaternary base and quaternary salt catalyst may be removed from the coal material by ample water washing for recylcing. Excess metal base will also be extracted into the water wash, and it may be reused. Excess alkylating or acylating agent may be conveniently removed from the treated coal bottoms by fractional distillation or by solvent extraction with pentane or other suitable solvent and may be reused.

To cap off all acidic protons in typical coal and coal bottoms employed in the catalytic process, less than about 2 days are required for 100% conversion, using only a slight excess of alkylating or acylating agent on −80 mesh coal material under atmospheric pressure and ambient temperature. A greater excess of alkylating or acylating agent will reduce the reaction time considerably.

A faster alkylation of acylation reaction may be obtained in a number of ways, one of which is to add the phase transfer reagent ($R_4QOR''$) directly to the coal material rather than to form this reagent in situ with the reaction in which the coal materials are alkylated or acylated. When this is done, substantially complete conversion of all the phenolic and carboxylic groups is achieved in a matter of minutes. The amount of quaternary base added ranges from about stoichiometric proportions to about 10 times the total number of acidic sites on the coal material which are capable of undergoing alkylation or acylation. As before, the quaternary salt that is generated in the alkylation or acylation step may be recovered and recycled by reacting it with fresh metal base to regenerate the quaternary base. By employing this two-step process, there is no contact between metal base and the coal bottoms, and the reaction is essentially complete in about one hour.

For example, in 10 g. of Illinois No. 6 coal, there are 35 mmoles of Ar—OH groups. An excess of a quaternary hydroxide along with an excess of an alkylating agent (about 4 to 5 times each) results in substantially complete alkylation in less than one hour at ambient conditions. In contrast, in the phase transfer catalyzed reaction, there is metal base present so that the alkylation (or acylation) must be carried out in an inert atmosphere, such as nitrogen, to avoid oxidation of the coal. In the case of the non-catalyzed process in which the formation of transfer reagent is kept separate from the alkylating or acylating reaction, the rate of oxidation of the coal is slow enough and is not competitive with the alkylation or acylation reaction. Therefore, another advantage of this non-catalyzed process is that the use of an inert atmosphere such as nitrogen is not required.

The reaction mixture may be stirred or agitated or mixed in some fashion to increase the interface or surface area between the phases, since there can be aqueous, organic liquid and solid coal bottoms phases present.

The reaction is carried out at ambient pressure, although low to moderate pressures (about 2 to 20 atmospheres) may be employed along with heating to increase the reaction rate.

Once the reagents and solvent if any are removed from the alkylated or acylated coal bottoms, infrared analysis may be conveniently used to determine that all the hydroxyl groups have been alkylated or acylated. If the added alkyl or acyl group is IR-active, then the appearance of the appropriate infrared frequency is observed. Other well-known analytical methods may also be employed if desired. The ultimate analysis of percent C, H, N, S and O is altered in a fashion which is consistent with the expected change due to the added alkyl or acyl substituent. Specifically, the increase in the H/C ratio of O-methylated Illinois No. 6 coal indicates that 4.5 methyl groups per 100 carbon atoms are added to the coal and 3.5 methyl groups per 100 carbon atoms are added to coal bottoms of the same type coal. The H/C ratio in the untreated Illinois No. 6 coal is 0.84 and the H/C ratio after O-methylation by the process of the invention is 0.89.

The thermogravimetric analysis of the O-methylated coal shows a significant increase in volatile organic content over the untreated coal (38% versus 32%). The solvent extractability of the carbonaceous material is greatly increased after it is O-alkylated or O-acylated. For example, Illinois No. 6 coal becomes more soluble in common organic solvents after it is oxygen-methylated, as shown in Table I below:

TABLE I

| | MAXIMUM SOLUBILITY (at 1 atm) | | |
|---|---|---|---|
| | Toluene | Tetrahydrofuran | Pyridine |
| Illinois #6 Coal | 3% | 17% | 27% |
| O—Methylated Illinois #6 Coal | 7% | 22% | 34% |

Liquids which are derived by solvent extraction of carbonaceous material treated in accordance with the invention evidence both improved quality and increased quantity over coal liquids derived from non-treated coal. For example, O-methylation of Illinois No. 6 coal results in 34% solubility in pyridine (as compared to 27% for non-O-methylated coal; see Table I). The soluble liquids from the O-alkylated or O-acylated carbonaceous materials have higher H/C ratio than the soluble products from untreated carbonaceous materials.

Lower rank coals having little or no caking properties will manifest considerably improved caking properties upon pyrolysis. Further, as a consequence of employing the process of the invention, pyrolysis of coal treated in accordance with the invention yields liquids and gases having improved stability and compatibility with petroleum products, as well as higher hydrogen content over coals not so treated.

Upon liquefaction, the viscosity and boiling range of liquefaction distillates are lowered, the yield of the distillates is increased and the liquids are more compatible with petroleum liquids. Liquefaction bottoms are also rendered more compatible with petroleum liquids and the solubility of the liquefaction bottoms in common organic solvents is increased.

The thermogravimetric analysis of the methylated coal bottoms shows a significant increase in volatile organic content over the untreated coal bottoms (48% versus 38%).

Coal bottoms treated in accordance with the invention may be recycled through the liquefaction, gasification, solubilization, etc., processes from which they were derived. Liquid products derived are more compatible with petroleum liquids than those derived from coal bottoms not so treated. The solvent extractability of the coal bottoms is greatly increased after it is O-alkylated or O-acylated. For example, Illinois No. 6 coal bottoms become more soluble in common organic solvents after oxygenmethylation, as shown in Table II below.

TABLE II

| | MAXIMUM SOLUBILITY (at 1 atm) (DMMF) | |
|---|---|---|
| | Toluene | Tetrahydrofuran |
| Illinois #6 Coal Bottoms | 22 | 60 |
| O—Methylation Illinois #6 Coal Bottoms | 95 | 95 |

Coal liquids which are derived by solvent extraction of coal bottoms treated in accordance with the invention evidence both improved quality and increased quantity over coal liquids derived from untreated coal.

The following examples serve to more fully describe the manner of making and using the above-described invention, as well as to set forth the best modes contemplated for carrying out various aspects of the invention. It is understood that these examples in no way serve to limit the true scope of this invention, but rather are presented for illustrative purposes.

EXAMPLE 1

Phase Transfer Non-Catalyzed Alkylation

Rawhide subbituminous coal was treated as follows: A slurry of 30.8 g. of Rawhide coal (−80 mesh) and 300 mmoles (free base) of tetrabutylammonium hydroxide (75% in aqueous solution) were mixed together at ambient temperature and 1 atm. pressure for a few minutes. Tetrahydrofuran (200 ml) and 500 mmoles of n-heptyliodide was then added and the reaction mixture was stirred for nearly three hours. The colorless water layer was then separated and fresh water added to wash out any residual quaternary salt from the organic phase, which contained the O-alkylated coal. The washing was continued until the pH of the wash water was neutral and no precipitate formed when silver nitrate was added to the wash water. (A by-product of the alkylation was tetrabutylammonium iodide which reacted with the silver nitrate to give a precipitate of AgI). The excess heptyliodide, water and THF were removed by vacuum distillation at 100°–110° C. The alkylated coal was then analyzed. Infrared analysis revealed substantially complete elimination of the hydroxyl band (3100–3500 $cm^{-1}$), as well as incorporation of the alkyl ether functionality (1000–1200 $cm^{-1}$) and incorporation of ester carbonyl functionality (1700–1735 $cm^{-1}$).

EXAMPLES 2–7

Phase Transfer Non-Catalyzed Alkylation

The following runs were made, employing the procedure set forth in Example 1. In each reaction, the quaternary base was tetrabutylammonium hydroxide. The base was present in at least stoichiometric amount of the number of acidic protons on the coal sample in the case of Rawhide and 2:1 in the case of Illinois No. 6.

TABLE III

PHASE TRANSFER NON-CATALYZED REACTIONS

| Example | Coal(1) | R'X(2) | Reaction Time/hr |
|---|---|---|---|
| 2 | Illinois #6 (80/100) | $CH_3I$, 200% | 1 |
| 3 | Illinois #6 (−80) | $C_4H_9I$, 200% | 3 |
| 4 | Illinois #6 (80/100) | $C_7H_{15}I$, 200% | 3 |
| 5 | Rawhide (80/100) | $CH_3I$, 200% | 1 |
| 6 | Rawhide (80/100) | $C_4H_9I$, 200% | 3 |
| 7 | Rawhide (80/100) | $C_7H_{15}I$, 200% | 3 |

Notes:
(1)Mesh size is indicated in parenthesis
(2)Weight percent relative to coal.

EXAMPLE 8

Phase Transfer Catalyzed Alkylation

Illinois No. 6 coal was treated as follows:

20 grams of Illinois No. 6 coal (80/100 mesh), 50 ml of a 50% aqueous NaOH solution, 150 ml of toluene, 70 mmoles of $CH_3I$ and 1 g. of tetrabutylammonium chloride were mixed together under a nitrogen atmosphere (the order of addition was not important). After five days, the aqueous layer was separated and the organic phase washed with water until the unreacted sodium hydroxide and catalyst were extracted out of the toluene. The toluene, water and excess iodomethane were removed under vacuum at 100° C. The O-alkylated coal was then analyzed. Infrared analysis revealed essentially complete elimination of the hydroxyl band (3100–3500 $cm^{-1}$), as well as incorporation of the alkyl ether functionality (1000–1200 $cm^{-1}$) and incorporation of the ester carbonyl functionality (1700–1735 $cm^{-1}$).

EXAMPLES 9–35

Phase Transfer Catalyzed Alkylation

A series of runs were made, employing the procedure set forth in Example 8. The reagents employed and the results obtained are set forth in Table IV below.

EXAMPLES 36–49

Phase Transfer Catalyzed Alkylation

Coal liquefaction bottoms derived from Illinois No. 6 and Wyodak coals are treated employing the reagents and amounts set forth in Table V below. In each case, the reactants were mixed together for 1 to 2 days at ambient temperature.

TABLE IV

PHASE TRANSFER CATALYZED REACTIONS

| Example | Coal (1) | Solvent | Catalyst (2) | Caustic (3) | R'X (4) |
|---|---|---|---|---|---|
| 9 | Ill. #6 (−300) | Toluene | B, 10% | KOH, 50% | $CH_3I$, 700% |
| 10 | Ill. #6 (−300) | Toluene | B, 10% | KOH, 50% | $C_2H_5I$, 500% |
| 11 | Ill. #6 (−100) | Toluene | B, 10% | KOH, 50% | $CH_3I$, 680% |
| 12 | Ill. #6 (−100) | Toluene | B, 10% | NaOH, 50% | $C_7H_{15}I$, 414% |
| 13 | Ill. #6 (−100) | Toluene | B, 10% | NaOH, 50% | Allylbromide, 420% |
| 14 | Wyodak (−100) | Toluene | B, 10% | NaOH, 50% | Allylbromide, 420% |
| 15 | Wyodak (−100) | Toluene | B, 10% | NaOH, 50% | $CH_3I$, 680% |
| 16 | Wyodak (−100) | Toluene | B, 10% | NaOH, 50% | Crotylbromide, 500% |
| 17 | Wyodak (−100) | Toluene | B, 10% | NaOH, 50% | $C_7H_{15}$, 414% |
| 18 | Wyodak (−100) | Toluene | B, 10% | NaOH, 50% | Cinnamylbromide, 500% |
| 19 | Ill. #6 (−100) | Toluene | B, 10% | NaOD, 40% | $CD_3I$, 137% |
| 20 | Ill. #6 (−100) | Toluene | B, 10% | NaOH, 50% | Propargylbromide, 375% |
| 21 | Wyodak (−100) | Toluene | B, 10% | NaOH, 50% | Propargylbromide, 624% |
| 22 | Wyodak (−100) | Toluene | B, 5% | NaOH, 50% | $(CH_3)_2SO_4$, 478% |
| 23 | Texas Lignite (−100) | Toluene | B, 10% | NaOH, 50% | Allylbromide, 450% |
| 24 | Ill. #6 (−100) | Toluene | B, 3.3% | NaOH, 12% | $C_4H_9Cl$, 427% |
| 25 | Ill. #6 (−100) | Toluene | B, 10% | NaOH, 20% | $C_3H_7I$, 388% |
| 26 | Ill. #6 (−80) | Xylenes | B, 10% | NaOH, 20% | 1-bromo-2-methyl, propane, 351% |
| 27 | Ill. #6 (−80) | Xylenes | A, 10% | NaOH, 20% | 2-iodopropane, 461% |
| 28 | Ill. #6 (−80) | Xylenes | T, 10% | NaOH, 12% | $CH_3I$, 540% |
| 29 | Ill. #6 (−80) | Toluene | T, 10% | NaOH, 12% | $CH_3I$, 50% |
| 30 | Ill. #6 (−80) | Toluene | T, 5.8% | NaOH, 12% | $CD_3I$, 72% |
| 31 | Ill. #6 (80/100) | Toluene | T, 5% | NaOH, 20% | $CD_3I$, 50% |
| 32 | Ill. #6 (80/100) | Toluene | T, 5% | NaOH, 20% | $C_4H_9I$, 100% |
| 33 | Ill. #6 (80/100) | THF | T, 5% | NaOH, 20% | $C_4H_9I$, 100% |
| 34 | Ill. #6 (300/325) | Toluene | T, 5% | NaOH, 20% | $C_4H_9I$, 100% |
| 35 | Ill. #6 (300/325) | THF | T, 5% | NaOH, 20% | $C_4H_9I$, 100% |

Notes:
(1) Mesh size is indicated in parentheses.
(2) B is benzylhexadecyldimethylammonium chloride, A is ADOGEN 464 and T is tetrabutylammonium iodide; weight percent is relative to coal.
(3) Weight percent of caustic in water.
(4) Weight percent relative to coal.

TABLE V

PHASE TRANSFER CATALYZED REACTIONS

| Example | Coal Liquefaction Bottoms (1) | Solvent | Catalyst (2) | Caustic (3) | R'X (4) |
|---|---|---|---|---|---|
| 36 | CLPP Bottoms-Ill. #6 (−80) | Benzene | B, 20% | NaOH, 50% | $C_2H_5I$, 2920% |
| 37 | CLPP Bottoms-Ill. #6 (−80) | Toluene | B, 10% | NaOH, 50% | $CH_3I$, 3900% |
| 38 | CLPP Bottoms-Ill. #6 (−80) | Toluene | B, 10% | NaOH, 50% | Propargylbromide, 158% |

TABLE V-continued

| PHASE TRANSFER CATALYZED REACTIONS | | | | | |
|---|---|---|---|---|---|
| Example | Coal Liquefaction Bottoms (1) | Solvent | Catalyst (2) | Caustic (3) | R'X (4) |
| 39 | CLPP Bottoms-Ill. #6 (−80) | Toluene | B, 10% | NaOH, 50% | Allylbromide, 526% |
| 40 | CLPP Bottoms-Ill. #6 (−80) | Toluene | B, 10% | NaOH, 50% | $C_7H_{15}I$, 460% |
| 41 | CLPP Bottoms-Ill. #6 (−80) | Toluene | B, 10% | NaOD, 40% | $CD_3I$, 760% |
| 42 | CLPP Bottoms-Ill. #6 (−80) | Toluene | B, 5% | NaOH, 50% | $(CH_3)_2SO_4$, 1200% |
| 43 | CLPP Bottoms-Ill. #6 (−80) | Toluene | B, 10% | NaOH, 50% | $C_{10}H_{21}Br$, 380% |
| 44 | CLPP Bottoms-Ill. #6 (−80) | Toluene | B, 10% | NaOH, 40% | $C_2H_5I$, 731% |
| 45 | CLPP Bottoms-Ill. #6 (−80) | Toluene | T, 5% | NaOH, 12% | $CD_3I$, 100% |
| 46 | CLPP Bottoms-Ill. #6 (−80) | Toluene | T, 5% | NaOH, 12% | $CH_3I$, 250% |
| 47 | U.S. Steel Full Range Tar | Xylenes | A, 4% | NaOH, 20% | $CH_3I$, 314% |
| 48 | CLPP Bottoms-Wyodak | Toluene | T, 5% | NaOH, 12% | $CH_3I$, 330% |
| 49 | CLPP Bottoms-Wyodak | Toluene | T, 5% | NaOH, 12% | $C_4H_9I$, 258% |

Definition of Symbols
(1) Coal origin of bottoms is given; CLPP = Coal Liquefaction Pilot Plant; Mesh size is indicated in parentheses.
(2) B is benzylhexadecyldimethylammonium chloride, A is ADOGEN 464 and T is tetrabutylammonium iodide. Weight percent is relative to carbonaceous material.
(3) Weight percent of metal base in water.
(4) Weight percent relative to coal bottoms.

In the case of CLPP bottoms, 3.5 alkyl groups were added to each 100 carbons in the sample. The H/C ratio of each sample increased in accordance to the chain length of the alkyl group added. The O-alkylated bottoms evidenced greater volatility and solubility in a variety of solvents and were more hydrogen rich and less viscous than the untreated bottoms.

A comparison between untreated coal liquefaction bottoms and O-methylated coal liquefaction bottoms gave the results shown in Table VI below.

TABLE VI

| Comparison Between Untreated and Treated Coal Bottoms | | |
|---|---|---|
| Property | Coal Liquefaction Bottoms | O—Methylated Coal Liquefaction Bottoms |
| Softening point (°C.) | 210 | 120 |
| Apparent viscosity (poise at 232° C.) | 185 | 19.5 |
| Apparent viscosity (poise at 316° C.) | 25 | 1 |
| % Volatile matter | 38 | 48 |
| % Oxidized | 62 | 52 |
| $T_i$ (°C.) | 310 | 250 |
| $T_f$ (°C.) | 600+ | 580 |

Table VI shows a dramatic decrease in the softening point and viscosity of coal bottoms, which improve processability. Phase transfer alkylation increases the volatile organic portion of liquefaction bottoms and lowers the boiling range ($T_i$ to $T_f$). Thus, more usable volatile organic coal bottoms are recovered by distillation.

COMPARATIVE EXAMPLE A 10.6 g of Illinois No. 6 coal, 6.08 g of sodium hydroxide, and 50 ml of water were slurried under nitrogen for 5 minutes. 8 g of dimethyl sulfate was added and the mixture was refluxed for two hours. Refluxing was stopped and 50 ml of 1 M sodium hydroxide solution and 8 g of dimethyl sulfate were added. Refluxing was continued for another two hours. The refluxed mixture was cooled overnight whereupon the treated coal was filtered and repeated washed with distilled water until no sulfate was detected in the filtrate. The washed and treated coal was then dried overnight at 80° C. under vacuum. A sample of both treated coal and untreated coal were analyzed for carbon, hydrogen, nitrogen, and sulfur content; the results are shown in Table VII below.

TABLE VII

| | Untreated Coal | Treated Coal Comparative Ex. A |
|---|---|---|
| Carbon | 62.95% | 68.49% |
| Hydrogen | 5.45% | 5.195% |
| Nitrogen | 1.15% | 1.24% |
| Sulfur | 3.86% | 3.835% |

COMPARATIVE EXAMPLE B 10 g of Wyodak coal bottoms (80 mesh), 6 g of sodium hydroxide and 5 ml of water were slurried under nitrogen for five minutes. 8 g of dimethyl sulfate was added and the mixture was refluxed for two hours. Refluxing was stopped and 50 ml of 1 M sodium hydroxide and 8 g of dimethyl sulfate were added. Refluxing was continued for another two hours. The refluxed mixture was cooled overnight whereupon the treated coal bottoms were filtered and repeated washed with distilled water until no sulfate was detected in the filtrate. The washed and treated coal bottoms were then dried overnight at 80° C. under vacuum. A sample of both treated and untreated coal bottoms was analyzed for carbon, hydrogen, nitrogen and sulfur. The results are shown in Table VIII below.

TABLE VIII

| | Untreated Coal Bottoms | Treated Coal Bottoms Comparative Example B |
|---|---|---|
| Carbon | 75.94% | 76.65% |
| Hydrogen | 4.09% | 4.10% |
| Nitrogen | 1.305% | 1.30% |
| Sulfur | 0.38% | 0.385% |

What is claimed is:

1. A composition of matter selected from the group consisting of coal and coal bottoms wherein the hydrogen atom of substantially all the hydroxyl and carboxyl groups of the coal and coal bottoms, has been replaced with a group selected from the group consisting of the $C_1$ to $C_{20}$ alkyl and acyl groups.

2. The composition of claim 1 wherein the composition of matter is coal.

3. The composition of claim 1 wherein substantially each hydrogen has been replaced with a $C_1$ to $C_4$ alkyl or acyl group.

4. The composition of claim 2 wherein substantially each hydrogen has been replaced with a $C_1$ to $C_4$ alkyl or acyl group.

5. The composition of claim 1 wherein substantially each hydrogen has been replaced with a $C_1$ to $C_4$ alkyl or acyl group.

6. The composition of claim 4 wherein substantially each hydrogen has been replaced with a $C_1$ to $C_4$ alkyl group.

7. The composition of claim 5 wherein substantially each hydrogen has been replaced with a methyl group.

8. The composition of claim 6 wherein substantially each hydrogen has been replaced with a methyl group.

* * * * *